US008061744B2

(12) United States Patent
Domian

(10) Patent No.: US 8,061,744 B2
(45) Date of Patent: Nov. 22, 2011

(54) POST HOLE DIGGER

(76) Inventor: Josef E. Domian, Mooresville, NC (US)

( * ) Notice: Subject to any disclaimer, the term of this patent is extended or adjusted under 35 U.S.C. 154(b) by 218 days.

(21) Appl. No.: 12/484,280

(22) Filed: Jun. 15, 2009

(65) Prior Publication Data

US 2010/0026024 A1 Feb. 4, 2010

Related U.S. Application Data

(60) Provisional application No. 61/084,998, filed on Jul. 30, 2008.

(51) Int. Cl.
*A01B 1/00* (2006.01)

(52) U.S. Cl. ..... 294/50.8; 294/57; 294/118

(58) Field of Classification Search ..... 294/50.6, 294/50.7, 50.8, 50.9, 57, 118; 175/396; 172/22, 172/372

See application file for complete search history.

(56) References Cited

U.S. PATENT DOCUMENTS 71,133 A * 11/1867 Carmichael ..... 111/101
127,713 A * 6/1872 Shirley ..... 111/101
183,976 A * 10/1876 Ryan ..... 294/50.8
342,516 A * 5/1886 Iwan ..... 175/396
603,858 A * 5/1898 Rakov ..... 294/49
934,029 A * 9/1909 West ..... 175/316
1,647,832 A * 11/1927 Kovar ..... 294/50.5
1,761,503 A * 6/1930 Tonhardt ..... 294/50.8
1,970,087 A * 8/1934 Gonsalves ..... 111/101
2,021,982 A * 11/1935 Byrne ..... 175/398
5,338,078 A * 8/1994 Basek ..... 294/50.5

* cited by examiner

*Primary Examiner* — Dean Kramer
(74) *Attorney, Agent, or Firm* — Dale J. Ream

(57) ABSTRACT

A post hole digger includes a pair of blades that face one another, a pair of shaft handles attached to the blades, and a pivot member that pivotally couples the shaft handles together. A pair of gripping handles are attached to, and are generally perpendicular to, the shaft handles, which provides a second gripping location for the user and enhances the ability to thrust and rotate the tool in the ground. The blades are off-set by at least ¼ inch from each other in order to improve a user's ability to rotate the post hole digger and remove soil from the hole. The blades include an angled distal edge, which has a leading edge portion, an intermediate edge portion and a trailing edge portion. The leading edge extends downwardly further than the intermediate portion, which in turn extends downwardly further than the trailing edge portion.

3 Claims, 5 Drawing Sheets

POST HOLE DIGGER

REFERENCE TO RELATED APPLICATIONS

This application claims the benefit of a U.S. provisional application Ser. No. 61/084,998 entitled POST HOLE DIGGER filed Jul. 30, 2008.

BACKGROUND OF THE INVENTION

1. Field of the Invention

The present invention relates to the field of post hole diggers. More specifically, the present invention relates to a post hole digger that enables a user to produce a vertical hold in the ground by pivoting the blades towards each other in a conventional manner and/or rotating the blades into the ground.

2. Description of the Related Art

Post hole diggers are frequently used for manually digging a hole within the earth for placement of a post therein. Traditional post hole diggers include two concave blades that face one another to form a cylindrical region generally about six inches in diameter. The blades are pivotally connected to one another proximate the top portion of the blades. Extending from each blade is a fixture or cap supporting a shaft handle extending approximately four feet in height. The blades are spaced apart from one another such that each shaft is proximate the inner surface of each of the blades. By thrusting the blades into the ground, the earth is secured between the blades by moving the upper end of the handles away from one another forcing the blades to pivot about the pivot toward one another.

Although assembly effective for their intended purposes in many soil conditions, they are less effective in dense, hard soils, such as clay. First, the vertical orientation of the handles may cause difficulty for some users to maintain a secure grasp when thrusting the post hole digger into the ground. The hard soil causes the post hole digger to come to an abrupt stop, requiring significant hand strength to keep the handles from sliding through the user's hands. Consequently, the user quickly fatigues and blisters result.

Also, traditional post hole diggers are not particularly effective in hard soil since repeated thrusting of the tool into the ground only minimally advances the intended hole. That is, prolonged inefficient effort is the only way to overcome the blunting away of the post hole digger.

Another disadvantage of traditional post hole diggers is that it is often difficult to force the handles away from each other in order to secure soil between the blades. Forcing the blades into the ground often does not sufficiently disrupt the earth so that it may be captured and removed from the hole. This problem becomes more pervasive as the hole gets deeper since the ability to manipulate the handles away from each other becomes diminished.

Accordingly, there is a need in the art for continued improvement of post hole diggers. Particularly, it would be desirable to have a post hole digger that is well-suited for use in hard soils. Additionally, it would be desirable to have a post hole digger that allows the user's hands to be positioned in a vertical and/or horizontal orientation in order to reduce user fatigue and improve downward force when thrusting the tool into the ground. Further, it would be desirable to have a post hole digger that improves the user's ability to capture and secure earth between the blades.

BRIEF SUMMARY OF THE INVENTION

To achieve the foregoing and other objects, the present invention, as embodied and broadly described herein, provides various embodiments of a post hole digger.

In the broadest sense, the present invention is a post hole digger that includes a pair of blades that face one another, a pair of shaft handles attached to the blades, a pivot member that pivotally couples the shaft handles together. The blades are off-set by at least ¼ inch from each other in order to improve the ability of a user to rotate the post hole digger through the ground. Optionally, a pair of gripping handles are attached to, and generally perpendicular to, the shaft handles, which provides a second gripping location for the user and enhances the ability of the user to thrust and rotate the tool into the ground.

In a preferred embodiment, the blades include an angled distal edge. The angled distal edge has a leading edge portion, an intermediate edge portion and a trailing edge portion that define the upwardly continuous angle extending between open side blade edges. The leading edge portion extends downwardly further than the intermediate portion, which in turn extends downwardly further than the trailing edge portion. The angled distal edge also is sharpened from the inside surface to the outside surface.

DESCRIPTION OF THE PREFERRED EMBODIMENTS

Figure 1:
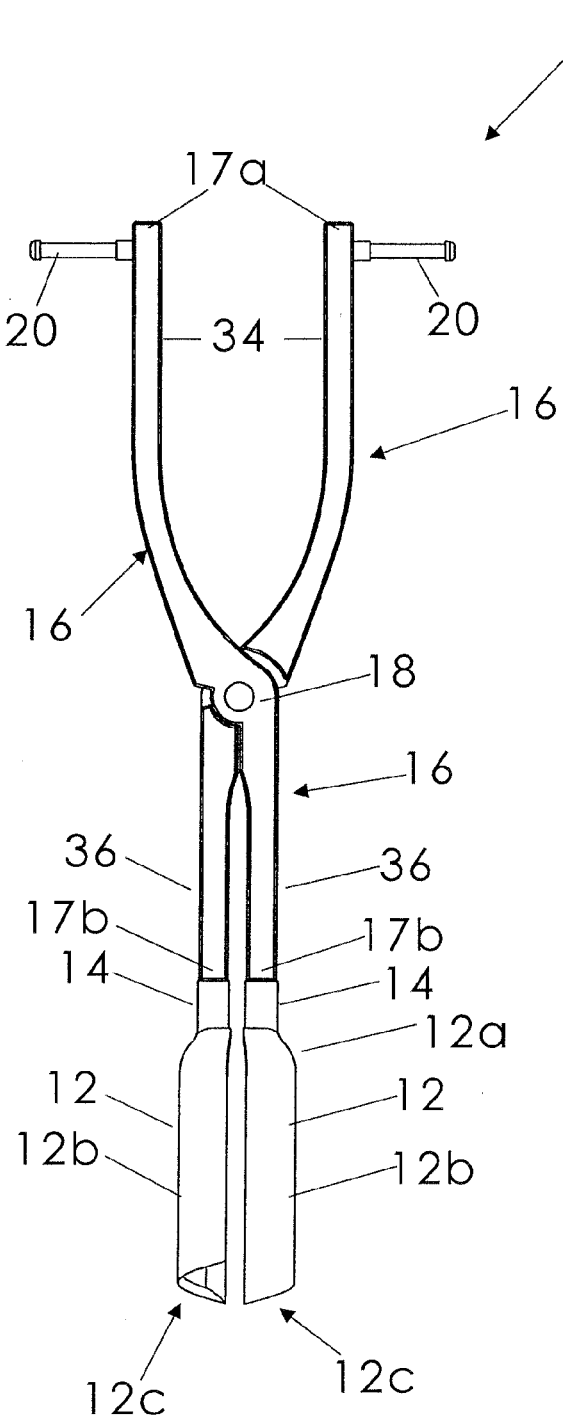
FIG. 1 is a front view of a post hole digger according to a preferred embodiment of the present invention and illustrated in a closed configuration.

A post hole digger 10 according to the present invention will now be described in detail with reference to FIGS. 1 to 6. More particularly, the post hole digger 10 includes a pair of concave blades 12 that face one another to form an off-set generally cylindrical region preferably about six inches in diameter. Extending upwardly from each blade 12 and attached thereto is a fixture or cap 14 supporting a shaft handle 16 which extends approximately 3½ to 4 feet in height. Each shaft handle 16 includes upper 17*a* and lower 17*b* ends. The shaft handles 16 are pivotally attached together at an intermediate position by a pivot member 18 (the pivot member 18 also being referred to as a pivot point). Gripping handles 20 extend perpendicular from near the upper ends 17*a* of each shaft handle 16 and extend outwardly therefrom (FIG. 1). The shaft handles 16 preferably extend a sufficient distance above the gripping handles 20 such that a user may grasp them to manipulate the tool 10 although it is understood that the shaft handles 16 may be grasped for operation above or below the gripping handles 20. A longitudinal leading edge 30 of each blade 12 includes a sharpened configuration, as will be described further below, such that the pair of blades may cut rotationally into soil when the post hole digger 10 is rotated in the ground. In addition, the pair of blades 12 are offset from each so as not to form a perfect cylinder at the closed configuration. This also enhances use of the post hole digger 10 when rotated in the ground.

Each blade 12 includes a top edge 12*a*, a pair of side edges 12*b*, and a distal edge 12*c* opposite the top edge 12*a*. The distal edge 12*c* includes a leading edge portion 13*a*, an intermediate edge portion 13*b*, and a trailing edge portion 13*c*. The distal edge 12*c* of the blades 12 is angled upward from the leading edge portion 13*a* to the trailing edge portion 13*c*. The angle is preferably between about 10 to 35 degrees and more preferably between about 15 to 30 degrees. The angle is illustrated as being continuous, however, it is to be understood that only a portion of the distal edge 12*c* may be angled or may be comprised of several angles. For example (not illustrated), the distal edge 12*c* may be angled from the leading edge portion to an intermediate edge portion and thereafter have a second angle to the trailing edge portion 13*c*. For the various embodiments of the present invention, the leading edge portion 13*a* extends further below than the intermediate edge portion which in turn extends further below than the trailing edge portion 13*c*. In the illustrated embodiment, the leading edge 13*a* is considered to be that edge which engages the earth first when turning the post hole digger 10. For a right handed person, the direction of turning would typically be counter-clockwise, nevertheless the tool may be made for being rotated clockwise.

The distal edge 12*c* is formed as a sharpened edge to enhance penetration when being thrust into the ground. To form the sharpened edge, preferably, the inside surface of the distal edge 12*c* is ground at an angle towards the outside surface.

The longitudinal leading edge 30 of the blades 12 also includes a sharpened configuration. To form the sharpened edge, preferably, the inside surface of the longitudinal edge 30 is ground at an angle towards the outside surface. The sharpened longitudinal edge 30 enhances the ability of the blades 12 to be rotated through the ground.

Figure 2:
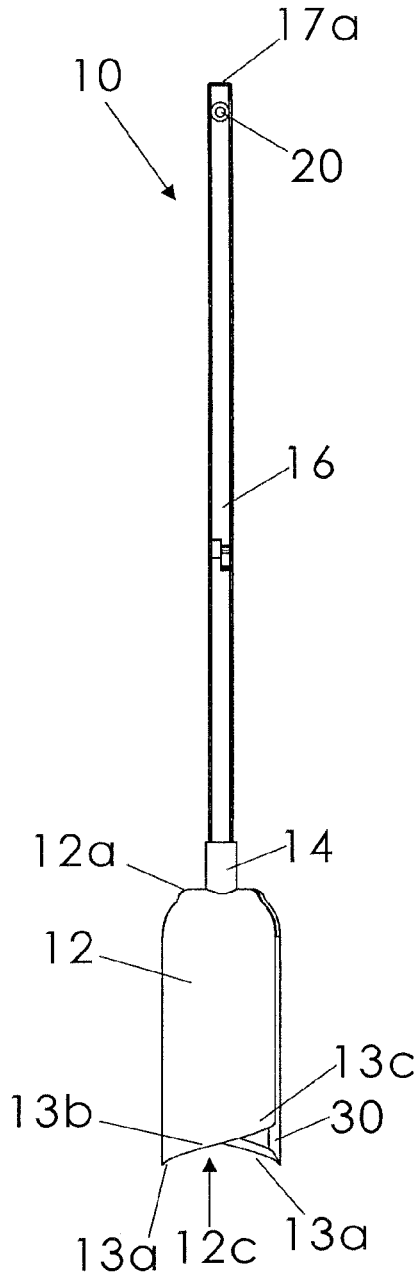
FIG. 2 is a side view of the post hole digger as in FIG. 1.
Figure 3:
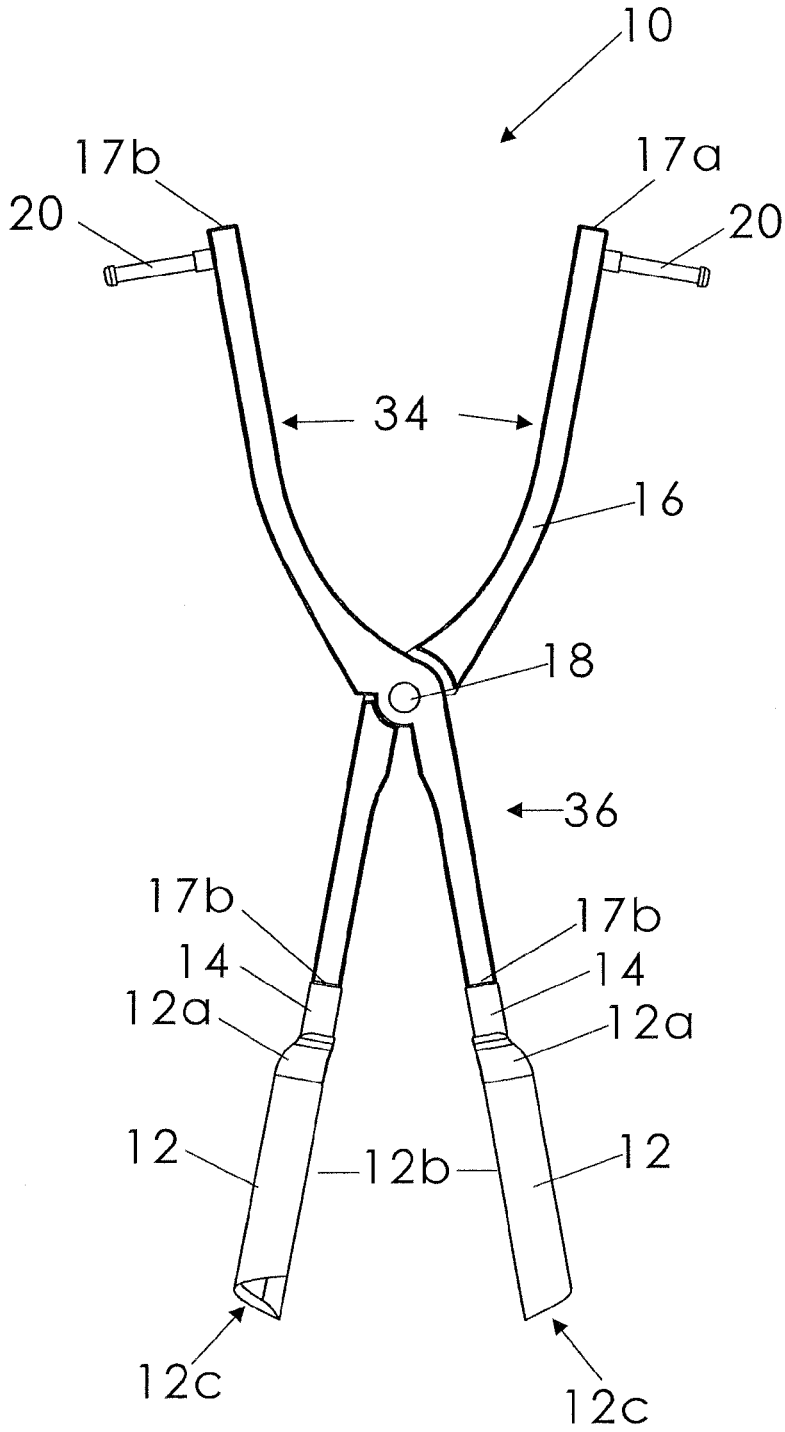
FIG. 3 is a front view of the post hole digger as in FIG. 1 illustrated in an open configuration.
Figure 4:
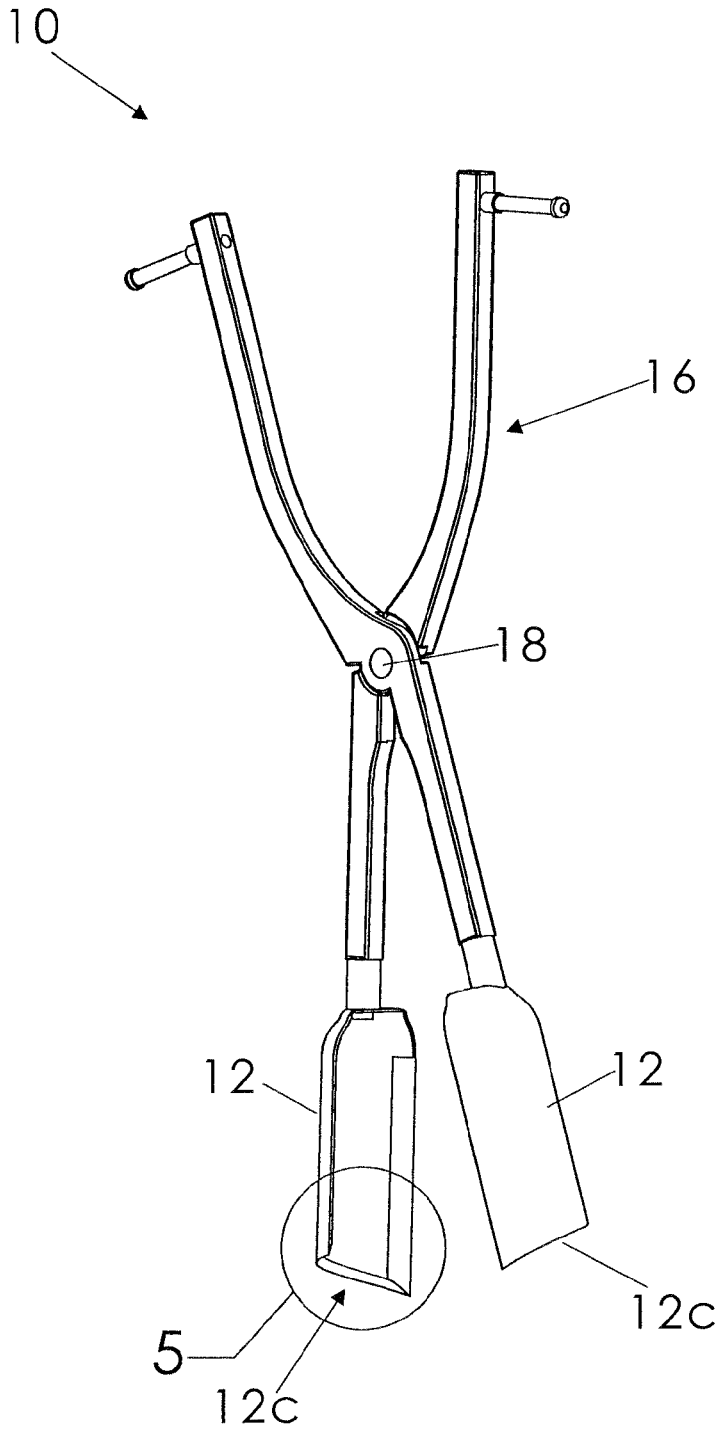
FIG. 4 is a perspective view of the post hole digger as in FIG. 3 that is rotated slightly.
Figure 5:
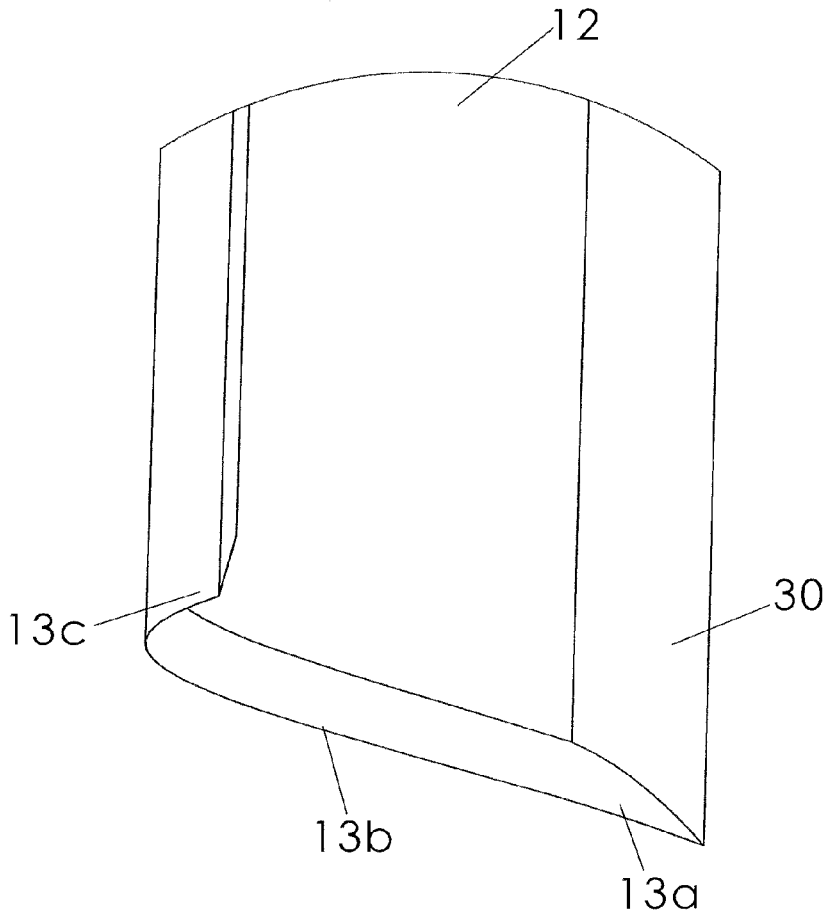
FIG. 5 is an isolated view on an enlarged scale taken from FIG. 4.
Figure 6:
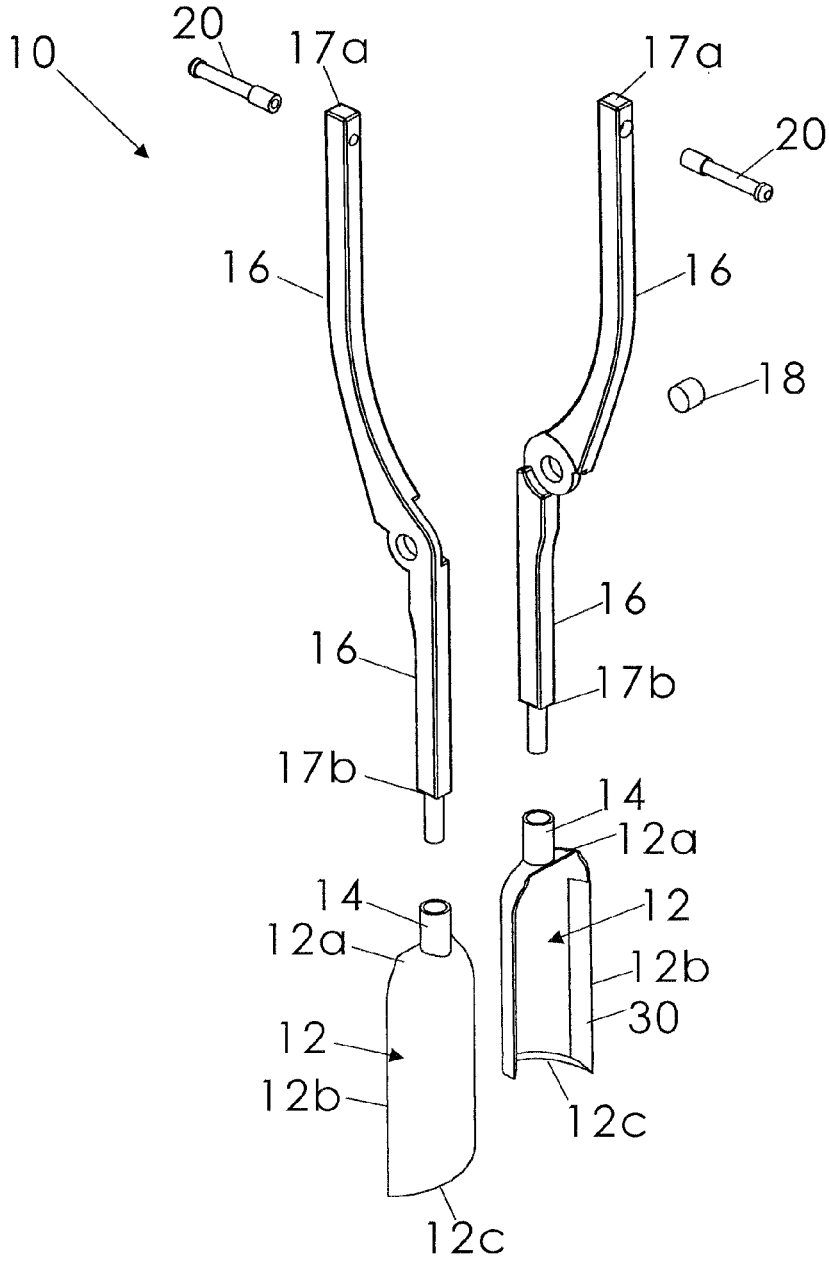
FIG. 6 is an exploded view of the post hole digger as in FIG. 1.

The blades 12 are off-set from each other such that they are not in true cylindrical relationship. This relationship may also be referred to as an irregular cylindrical configuration. More particularly, each leading edge 13*a* may be off-set outwardly by about ¼ to ½ inch from the trailing edge portion 13*c* of the other blade 12 (FIG. 2). By being off-set, the blades 12 may cut through the soil when being rotated into the ground. In this fashion, the post hole digger 10 may more easily be worked into the ground and capture of soil is improved.

The shaft handles 16 are attached together at an intermediate position by the pivot member 18. The pivot member 18 divides the shaft handles 16 into an upper portion 34, which the user may grasp to utilize the tool, and a lower portion 36 that is coupled to the blades 12 via the caps 14. The pivot member 18 is oversized and of a heavy duty construction in order to sustain torque loads associated with rotating the post hole digger 10 into the ground. The post hole digger 10 is opened by moving the upper portions 34 outward away from each other, and closed by moving the upper portion 34 closer together.

The lower portions 36 are generally parallel with each other, and also parallel with the blades 12, when the post hole digger 10 is in the closed capturing position. The upper portions 34 are firstly arcuate and in a generally U-shaped configuration, extending away from the pivot member 18 at the closed configuration. Not to be construed as limiting, in the preferred embodiment, a parallel portion of the upper portions 34 are spaced about 12 inches apart and the lower portions 36 are spaced about one inch apart.

Advantageously, by having shaft handles 16 with parallel lower portions 36, the post hole digger 10 may be worked within holes without having to greatly enlarge the hole, as is often required by traditional post hole diggers. Also an advantage, the spaced apart upper portions 34 allow for the user to apply greater twisting torque, whether the blades 12 are in the open or closed position, than that of traditional post hole diggers that have handles in closer proximity to each other.

The gripping handles 20 extend perpendicular from the upper portion 34 of the shaft handles 16. The gripping handles 20 provide an alternative location for a user to grasp the post hole digger 10. The horizontal orientation of the gripping handles 20 provides a user with a gripping surface that may allow the user to apply greater force in digging a hole with less fatigue. The gripping handles 20 also provide a suitable gripping structure for the user to rotate the post hole digger 10 into the ground.

In operation, the user may grasp the post hole digger 10 either on the gripping handles 20 or shaft handles 16 depending on soil conditions, comfort, strength of the user, and whether the user is thrusting the tool into the ground or rotating the tool. The two gripping locations also allow for the user to switch between positions should fatigue occur in either position.

When thrusting into the earth, the angled distal edge 12*c* of the blades 12 allows the tool to bite into the ground. The user may then rotate the post hole digger 10 to work the tool through difficult soil, rotate the tool to improve capture of the soil, or to close the blades 12 and remove the soil from the hole.

As the blades are offset, rotation of the post hole digger 10 causes the leading longitudinal edges 30 to cut through the soil at a location slightly outside the cut made by the other blade. In this fashion, the blades 12 may be worked into the soil and the soil is loosened for easier removal from the hole.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appending claims.

I claim:

1. A post hole digger, comprising:

a pair of elongate shaft handles having upper and lower ends, each said shaft handle defining an upper portion and a lower portion;

wherein respective upper portions of said shaft handles define a generally U-shaped configuration at said closed configuration;

wherein said shaft handles are pivotally coupled together by a pivot member situated between respective upper and lower portions, said shaft handles being pivotally movable between open and closed configurations;

a pair of blades attached to respective lower ends of said shaft handles, each blade having a generally concave configuration with each blade concave configuration facing a corresponding concave configuration of the other blade;

a pair of gripping handles attached to respective upper ends of said pair of shaft handles, said gripping handles being situated generally perpendicular to respective shaft handles and extending outwardly in opposite directions;

wherein:

each blade is offset from the other blade such that said blades form an irregular cylindrical configuration at said closed configuration for enhanced soil penetration when rotated therein;

respective lower portions of said shaft handles are generally parallel to one another and generally parallel to said pair of blades at said closed configuration;

each blade includes opposed side edges and a distal edge;

one side edge is a leading longitudinal edge that is sharpened from an inner distal edge surface toward an outer distal edge surface, said offset blades being configured such that rotation of said offset blades causes said leading longitudinal edge to cut through soil at a location slightly outside a cut made by the other blade; and each distal edge includes an angled configuration between respective blade side edges, said each distal edge including:

a leading edge portion that extends downwardly a first distance;

an intermediate edge portion connected to said leading edge portion that extends downwardly a second distance that is less than said first distance; and a trailing edge portion connected to said intermediate edge portion that extends downwardly a third distance that is less than said second distance.

2. The post hole digger as in claim 1, wherein each said distal edge defines an angle of between 10 and 35 degrees.

3. The post hole digger as in claim 1, wherein said blades are separated from one another by at least ¼ inch at said closed configuration.

* * * * *